US007134799B2

(12) United States Patent
Gueret

(10) Patent No.: US 7,134,799 B2
(45) Date of Patent: Nov. 14, 2006

(54) APPLICATOR INCLUDING AN APPLICATOR ELEMENT FOR APPLYING A SUBSTANCE, IN PARTICULAR A COSMETIC OR ANOTHER CARE PRODUCT

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 143 days.

(21) Appl. No.: 10/761,337

(22) Filed: Jan. 22, 2004

(65) Prior Publication Data

US 2004/0161285 A1 Aug. 19, 2004

Related U.S. Application Data

(60) Provisional application No. 60/461,806, filed on Apr. 11, 2003.

(30) Foreign Application Priority Data

Jan. 23, 2003 (FR) ..... 03 00722

(51) Int. Cl.
*A45D 33/00* (2006.01)
*A46B 11/00* (2006.01)

(52) U.S. Cl. ..... 401/130; 401/126; 401/122; 401/11

(58) Field of Classification Search ..... 401/126, 401/128, 130, 265, 266; 222/566
See application file for complete search history.

(56) References Cited

U.S. PATENT DOCUMENTS

| | | | | |
|---|---|---|---|---|
| 2,283,463 | A * | 5/1942 | Rupp | 401/263 |
| 2,559,553 | A * | 7/1951 | Wolff | 401/172 |
| 2,876,475 | A * | 3/1959 | Mann | 401/266 |
| 2,884,877 | A * | 5/1959 | Nalbone et al. | 222/391 |

FOREIGN PATENT DOCUMENTS

| | | |
|---|---|---|
| FR | 2 010 051 A | 2/1970 |
| FR | 2 038 293 A | 1/1971 |
| FR | 2 796 532 A | 1/2001 |
| FR | 2 814 923 A | 4/2002 |

* cited by examiner

*Primary Examiner*—David J. Walczak
(74) *Attorney, Agent, or Firm*—Oliff & Berridge, PLC

(57) ABSTRACT

An applicator is configured to apply a substance on a portion of the human body and comprises an applicator element. The applicator element comprises at least two walls forming therebetween a cavity suitable for retaining the substance, at least one slot that extends along a longitudinal axis and through which the substance contained in the cavity is dispensed in order to be applied, and at least one opening whereby the cavity opens to the outside. In embodiments, the opening comprises at least one portion with a width in a plane extending transversely to the slot that is greater than a width of the slot in the same plane.

47 Claims, 7 Drawing Sheets

APPLICATOR INCLUDING AN APPLICATOR ELEMENT FOR APPLYING A SUBSTANCE, IN PARTICULAR A COSMETIC OR ANOTHER CARE PRODUCT

This application claims the benefit of U.S. Provisional Application No. 60/461,806 filed on Apr. 11, 2003, the entire disclosure of which is incorporated by reference herein.

FIELD OF INVENTION

The present invention relates to an applicator including an applicator element for applying a substance, such as a fluid, cosmetic or other care products.

BACKGROUND

French patent document No. 2,730,704 describes an applicator provided with at least one slot at the end of a stem. Such an applicator cannot retain much substance. French patent document No. 2,730,704 describes an applicator that can hold more substance. This applicator presents an annular cylindrical space that communicates with a slot at the end of a stem. Such an applicator is unsuitable for certain uses in which it is desirable for the slot to be disposed otherwise, whether for ergonomic reasons or due to the nature of the region to be treated.

SUMMARY OF THE INVENTION

Exemplary embodiments of the invention provide an applicator in which the substance is held by capillarity, which is easy to load with substance, and/or which can be provided in a variety of forms appropriate for applying a substance to diverse surfaces, such as eyelashes, skin, lips, fingernails and/or toenails.

Exemplary embodiments of the invention provide an applicator configured to apply a substance on a portion of the human body, for example, on skin, on lips, on hair and/or on nails. In embodiments, the applicator comprises an applicator element, and the applicator element comprises: at least two walls forming therebetween a cavity suitable for retaining the substance; at least one slot that extends along a longitudinal axis and through which the substance contained in the cavity is dispensed in order to be applied; and at least one opening whereby the cavity opens to the outside, the opening having at least one portion with a width in a plane extending transversely to the slot that is greater than a width of the slot in the same plane.

In embodiments, the wider opening allows the cavity to be loaded with substance, where appropriate, via the opening in a relatively easy manner. The applicator may provide a considerable endurance between refills because of a reserve of substance that can be retained in the cavity.

The shape of the walls may easily be modified without impeding provision of the slot or the opening. Thus, the applicator may be provided in various exemplary embodiments that are adapted for application to specific regions of the body and/or the face.

In exemplary embodiments, the slot is entirely separate from the opening. Further, the slot may be situated substantially opposite from the opening.

In exemplary embodiments, the applicator may be made in such a manner as to deliver the substance in the form of a uniform film of substantially constant thickness. Further, the applicator may deliver the substance in such a manner as to provide instant wetting of the application surface, or with instant saturation of the surface, for example, when application is performed on keratinous fibers.

In exemplary embodiments, the applicator may enable the substance to be applied without subjecting the substance to undesirably high levels of mechanical stress that might lead to a change in the rheological properties, such as the consistency, for example, of the substance. Thus, exemplary embodiments of the applicator may make it possible to apply substances where conventional applicators, such as brushes, are not entirely satisfactory.

In exemplary embodiments, the width of the slot and the shape of the slot may be selected as a function of the nature of the substance and the flow rate desired during application.

In exemplary embodiments, the applicator may enable the substance to be applied regardless of the position of the applicator relative to the surface on which the substance is to be applied. This may be a result of the substance being held in the slot by capillarity.

In exemplary embodiments, the applicator may be arranged to apply a cosmetic and/or another care product, for example, for makeup purposes, on skin and/or on keratinous surfaces such as nails, hair, eyelashes, or eyebrows.

In exemplary embodiments, the slot is situated between the two walls. In embodiments, the walls may be elongate in shape with a longitudinal axis substantially parallel to the axis of the slot.

In cross-section, the walls may define a shape that is substantially V-shaped, C-shaped, U-shaped, or W-shaped, for example, with at least one slot formed through a bottom of a concave portion of the V-, C-, U-, or W-shape, as the case may be.

In embodiments in which the cross-section of the walls is generally U-shaped, the slot may be formed between two substantially parallel rims at the bottom of the U-shape. These rims may project outward from the cavity or may be reentrant.

In exemplary embodiments of the invention, the applicator element comprises only one slot. In other exemplary embodiments, the applicator element comprises at least two slots, which may be, for example, substantially parallel. In embodiments in which the applicator element comprises a W-shaped cross-section, the two slots may be formed through the bottoms of the two concave portions of the W-shape. In embodiments in which the cross-section of the two walls defines a U-shape or a V-shape, the two slots may be formed through opposite sides of the bottom of the concave portion of the U- or V-shape.

In embodiments in which the cross-section is V-shaped, each limb of the V-shape may be rectilinear or may have an outwardly-directed concave face.

In exemplary embodiments, the slot may be substantially rectilinear. In other exemplary embodiments, the slot may be curved. For example, the slot may have a shape of a portion of a circle or an ellipse. The slot may have a shape adapted to the shape of the surface on which the substance is to be applied. For example, the slot may have a concave shape so to fit over the bulging surface of a nail. In other embodiments, the slot may be convex or may extend along an undulating curve.

In exemplary embodiments, the slot and/or the opening may have a width that is substantially constant over its entire length. In other exemplary embodiments, the slot and/or the opening may have a width that is not constant over its length, for example, due to variations in the spacing between the walls.

In exemplary embodiments, the slot may have edges that are linear in shape. In other exemplary embodiments, the slot may have edges that are serrated, for example, for applying substance on eyelashes and/or eyebrows. Such serrated edges may define two rows of teeth, for example, two parallel rows. The respective teeth of the rows may be in registration with one another or may be in a staggered configuration, for example, in order to grip eyelashes more firmly.

In embodiments in which the edges of the slot carry teeth, the substance may be applied on eyelashes without actual direct contact between an eyelash and the applicator element, the eyelash making contact only with the substance. This may make it easier to coat eyelashes with the substance and/or may confer a feeling of softness during application.

In exemplary embodiments of the invention, the slot and/or the opening is uninterrupted along its entire length. In other exemplary embodiments, the slot or the opening is interrupted, for example, by at least one bridge of material interconnecting the two walls. The term "slot" as used throughout this disclosure thus encompasses a succession of orifices disposed along an axis.

In exemplary embodiments in which the applicator includes a stem connecting the applicator element to a handle element, the slot may extend substantially parallel to the longitudinal direction of the stem. In other exemplary embodiments, the slot does not extend parallel to the longitudinal direction of the stem. For example, the slot may be perpendicular to the longitudinal direction.

In exemplary embodiments, the applicator element may be flocked at least in part. This may make it possible, for example, to retain a greater quantity of substance, particularly if the substance is not very viscous.

In exemplary embodiments, the opening may have at least one edge that is flocked at least in part. For example, the opening may have two edges that are substantially flocked. Such edges may be parallel, where appropriate.

In exemplary embodiments, the walls may be elastically deformable or may be made of a rigid material. In exemplary embodiments, the applicator element may be made out of at least one of the following materials: a thermoplastic material, a thermosetting material, an elastomer, glass, wood, and metal.

In exemplary embodiments, the applicator may include a handle member.

Exemplary embodiments of the invention provide a packaging and applicator device for a substance, such as a cosmetic or another care product, the device comprising: a receptacle containing a substance for application; and an applicator as defined above.

In exemplary embodiments of the invention, the applicator may be removably fastened on the receptacle and may be arranged to be capable of closing the receptacle in a leaktight manner.

In exemplary embodiments, the device may include a wiper, which may, in embodiments, comprise a block of foam. Other types of wipers may also be used according to this invention, for example, a wiper having optionally flocked lips.

In exemplary embodiments, the walls of the applicator element serve to protect the substance contained in the cavity from being wiped away while the applicator element passes through the wiper.

In other exemplary embodiments, the applicator may be permanently fastened to the receptacle and may include a channel that enables the substance contained in the receptacle to flow into the cavity of the applicator element.

Exemplary embodiments of the invention provide the use of an applicator, as defined above, to apply a substance on a region of the body or the face.

During such use, the applicator element is filled with substance, and then the substance is applied on the desired region.

For example, the applicator element may be filled with substance by being engaged in a receptacle containing the substance. In such embodiments, the applicator may be advantageously wiped as the applicator is withdrawn from the receptacle.

In other embodiments, the applicator element may be filled with substance by a channel that places the cavity of the applicator element into communication with a tank containing the substance.

Exemplary embodiments of the invention provide a method of applying a substance to a portion of the human body, the method comprising: providing an applicator comprising at least two walls forming therebetween a cavity suitable for retaining the substance, at least one slot that extends along a longitudinal axis and through which the substance contained in the cavity is dispensed in order to be applied, and at least one opening whereby the cavity opens to the outside, the opening having at least one portion with a width in a plane extending transversely to the slot that is greater than a width of the slot in the same plane; loading the cavity with substance; and applying the substance to a portion of the human body via at least one of the slot and the opening.

In advantageous embodiments, the opening may have at least one edge that is flocked at least in part. For example, the opening may have two opposite edges that are flocked.

BRIEF DESCRIPTION OF THE DRAWINGS

The present invention will be better understood on reading the following detailed description of non-limiting embodiments thereof, and on examining the accompanying drawings, in which.

DETAILED DESCRIPTION OF EXEMPLARY EMBODIMENTS

The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

Figure 1:
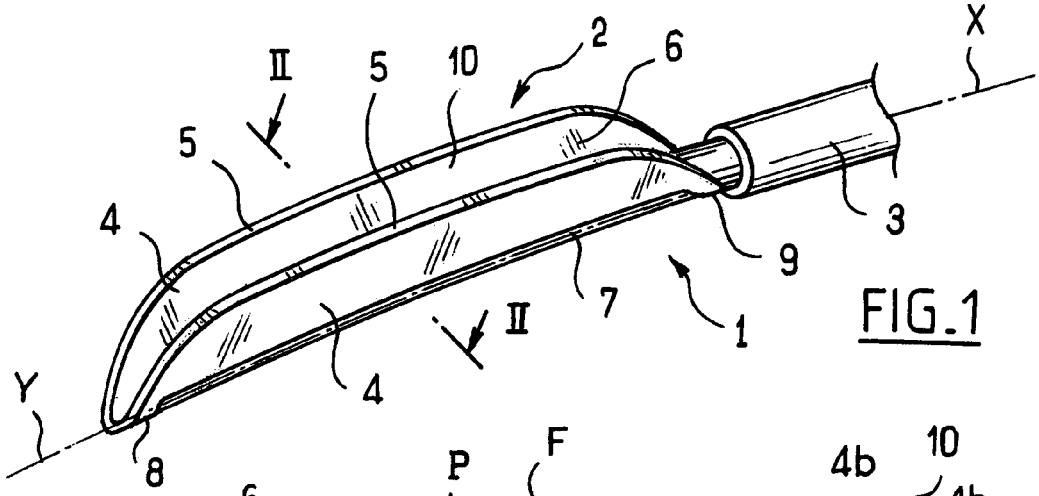
FIG. 1 is a diagrammatic and fragmentary perspective view of an applicator according to an embodiment of this invention.

FIG. 1 shows an applicator 1 comprising an applicator element 2 connected to one end of a stem 3 along a longitudinal axis X.

Figure 2:
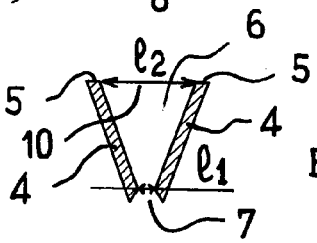
FIG. 2 is a diagrammatic and fragmentary cross-section view along section II—II of FIG. 1.

The applicator element 2 comprises two walls 4 of elongate shape having two facing faces that are not mutually parallel. In the exemplary embodiment shown, the walls extend substantially parallel to the axis X. Further, in cross-section, the walls may define a shape that is substantially V-shaped, as shown in FIG. 2. The top edges 5 of the walls 4 may be joined together at longitudinal ends of the applicator element 2.

Therebetween, the walls 4 provide a cavity 6 suitable for retaining a substance P, for example, by capillarity.

At a bottom of the V-shape, the applicator element 2 comprises a slot 7 that extends along almost the entire length of the walls 4. The slot 7 may serve to dispense the substance P contained in the cavity 6.

The slot 7 may have a width that is narrow enough to retain the substance contained in the cavity 6 by capillarity and to prevent the substance from flowing out of the cavity 6 under the effect of gravity.

The slot 7 may enable the substance to be dispensed by capillarity onto a surface to be treated once the applicator element 2 is close enough to the surface. In such a manner, the substance that is retained by the slot 7 may be used to wet the surface.

The slot 7 may be closed at the longitudinal ends by two respective bridges of material 8 and 9 interconnecting the walls 4.

On a side opposite from the slot 7, the applicator element 2 may have an opening 10 that enables the cavity 6 to be filled with substance. The opening 10 may extend along substantially the entire length of the walls 4.

As shown in FIG. 2, at least in a central region of the applicator element 2, the opening 10 may have a width $l_2$ that is greater than a width $l_1$ of the slot 7, with the widths $l_1$ and $l_2$ being measured in a plane perpendicular to the longitudinal axis X of the slot 7. As also shown in the section plane of FIG. 2, the applicator element 2 may lie entirely on only one side of the opening 10. For example, $l_2$ may be greater than or equal to $1.5xl_1$, or $l_2$ may be greater than or equal to $3xl_1$, with $l_1$ being close to 0.75 millimeters (mm), for example and with $l_2$ being close to 2 mm, for example.

In the exemplary embodiment shown, the walls 4 may be made of a material that is elastically deformable, such as, for example, an elastomer. However, the walls 4 may also be made of a material that is relatively rigid, for example, glass, wood or metal.

Figure 3:
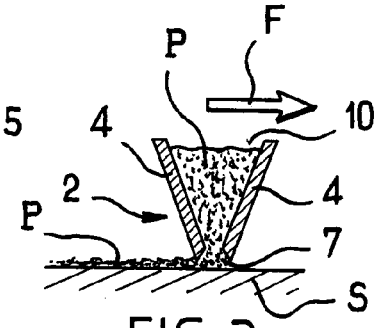
FIG. 3 is a view analogous to FIG. 2, illustrating the applicator during application.

In order to apply the substance on a surface S, such as, for example, on skin as shown in FIG. 3, a user brings the slot 7 of the applicator element 2 close to or into contact with the surface S so that the substance P contained between the edges of the slot 7 can wet the surface S and can become deposited thereon.

By moving the applicator element 2 in a direction that is transverse to the axis X, i.e., along arrow F shown in FIG. 3, it is possible to deposit a film of substance P of substantially constant thickness on the treated surface S.

The substance P may optionally be deposited without the applicator element 2 coming into contact with the treated surface S, such that only the substance P contained in the slot 7 comes into contact with the treated surface S. This enables substance P to be deposited without any risk of the applicator element 2 removing any substance previously deposited on the surface S as the applicator element 2 is moved past, and without leaving marks.

However the substance P may also be deposited with the applicator element 2 coming into contact with the surface to be treated.

When the walls 4 are elastically deformable, the slot 7 may deform so as to match the shape of the treated surface.

Thus, when the substance is to be applied to a (finger- or toe-) nail, the slot 7 may deform so as to match the bulging shape of the nail, and/or may enable a uniform application of the substance on the nail.

In various exemplary embodiments, the cross-section defined by the walls 4 may be of a shape other than a V-shape.

As shown in FIGS. 4 to 7, the walls 4 may define a substantially U-shaped cross-section, for example, comprising top portions 4*a* that are planar and mutually parallel, and that are extended downwardly by bottom portions 4*b* that converge towards each other.

Figure 4:
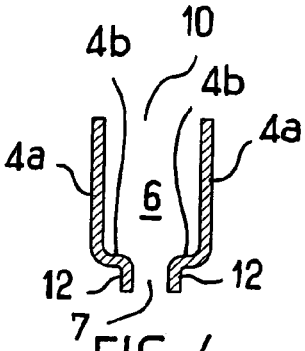
FIGS. 4 to 12 are diagrammatic and fragmentary cross-section views of applicator elements according to various exemplary embodiments of this invention.

FIG. 4 shows that the slot 7 may be formed between two parallel longitudinal rims 12 connected to the bottom portions 4*b* of the U-shape. The rims 12 may project outward, as shown in the exemplary embodiment of FIG. 4.

The bottom portions 4*b* may be inclined to a greater or lesser extent relative to the top portions 4*a*.

Figure 5:
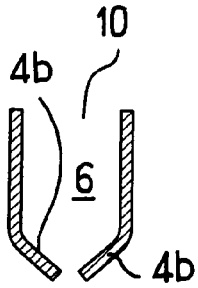
Figure 6:
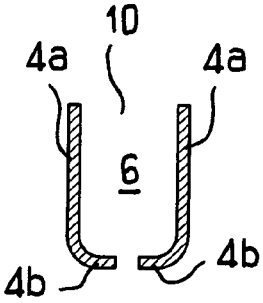

For example, in the exemplary embodiment of FIG. 5 the bottom portions 4*b* may slope downward to a greater extent than the bottom portions 4*b* in the exemplary embodiment of FIG. 6.

Figure 7:
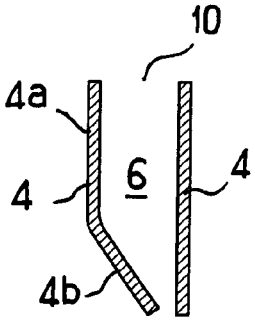

In the exemplary embodiment of FIG. 7, the walls 4 are not symmetrical to each other about a plane. By way of example, a first wall may be planar while the other wall has a top portion 4*a* that is parallel to the first wall 4, and that is extended by a bottom portion 4*b* that converges towards the first wall.

Figure 8:
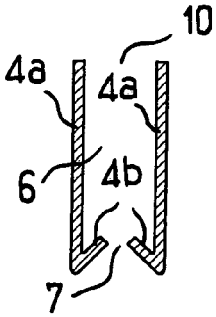

The bottom portions 4*b* need not be directed entirely downward. For example, as shown in FIG. 8, the bottom portions 4*b* may be re-entrant, curving up toward the opening 10, such that in cross-section the walls 4 define a shape that is substantially W-shaped. As shown in FIG. 8, the slot 7 may thus be set back slightly from the bottom end of the applicator element 2.

Figure 9:
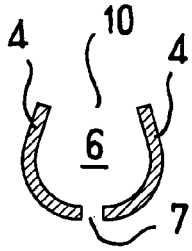

The walls 4 may also define a cross-section that is C-shaped. For example, the slot 7 may be situated in a bottom of a concave portion of the C-shape, as shown in FIG. 9.

In the exemplary embodiments described above, there is only one slot 7.

Figure 10:
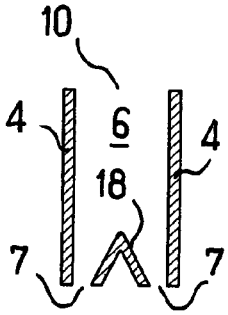
Figure 11:
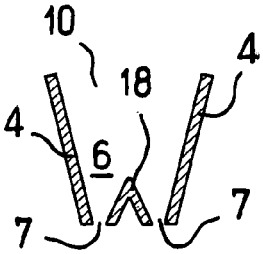
Figure 12:
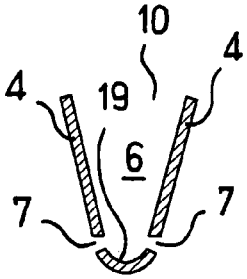

However, according to various exemplary embodiments, such as shown in FIGS. 10 to 12, the applicator element 2 may have plurality of slots. For example, the applicator element 2 may have two parallel slots 7.

In the exemplary embodiment of FIG. 10, the walls 4 are substantially parallel and two slots 7 are defined, one on either side of an intermediate wall 18 having a cross-section in the form of an upside-down V-shape.

In the exemplary embodiment of FIG. 11, the walls 4 are not parallel, but converge towards each other in a direction toward the two slots 7. The slots 7 may be separated by an intermediate wall 18 of a shape that is not necessarily an upside-down V-shape.

For example, FIG. 12 shows an applicator element having two slots 7 disposed on either side of an intermediate wall 19 having a cross-section in the form of a circular arc with a concave side facing toward an inside of the V-shape.

In the exemplary embodiments described above, the slot(s) 7 may extend along an axis Y that is substantially rectilinear and parallel to the axis X.

Figure 13:
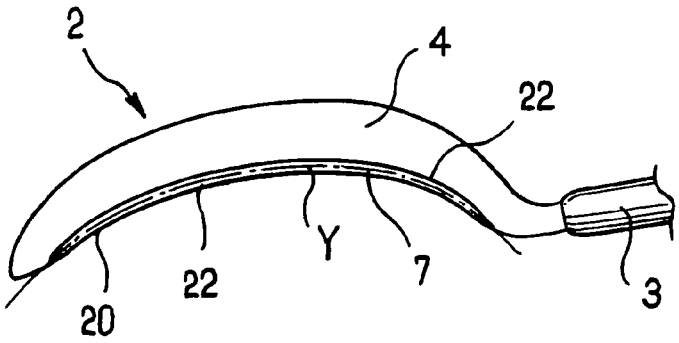
FIGS. 13 to 19 are diagrammatic and fragmentary perspective views of applicators according to various exemplary embodiments of this invention.

FIG. 13 shows an applicator element 2 for providing satisfactory application on a curved surface, such as a nail.

The applicator element 2 may comprise two walls 4 having a shape that is curved in such a manner as to define a slot 7 that is outwardly concave, extending along a curved axis Y, for example, in the form of a portion of a circle or an arc of an ellipse, matching the bulging shape of nails.

Figure 18:
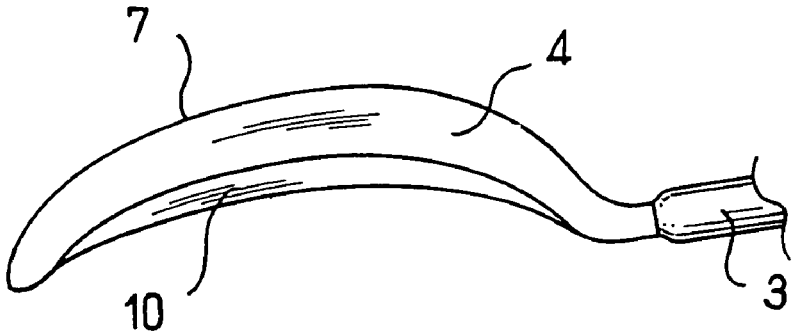

As shown in FIG. 18, the slot 7 may be outwardly convex and the opening 10 may lie in a concave side of the applicator element. This shape of the slot 7 may particularly be suitable for application to eyelashes.

Figure 19:
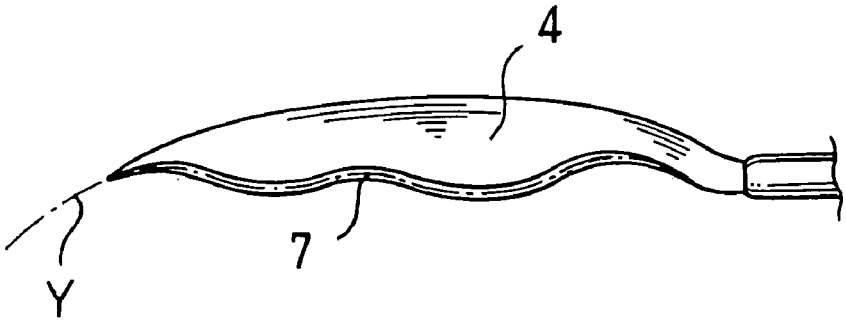

In another exemplary embodiment, the slot 7 may comprise an undulating curve, as shown in FIG. 19.

Figure 14:
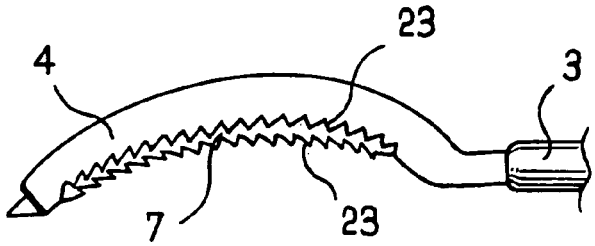

The slot 7 may be formed between two linearly-shaped parallel edges 22, for example, as shown in FIGS. 1 and 13. Alternatively, the slot 7 may be formed between two rows of teeth 23, for example, as shown in FIG. 14.

The applicator element may be made with such teeth 23, particularly when the applicator element is for applying substance on keratinous fibers, for example, eyelashes and/or eyebrows.

The teeth 23 in one row may extend in registration with the teeth 23 in the other row. Alternatively, the teeth 23 may be disposed in a staggered configuration so as to grip the eyelashes more firmly, where appropriate.

In the exemplary embodiments described above, the slot 7 is uninterrupted.

Figure 15:
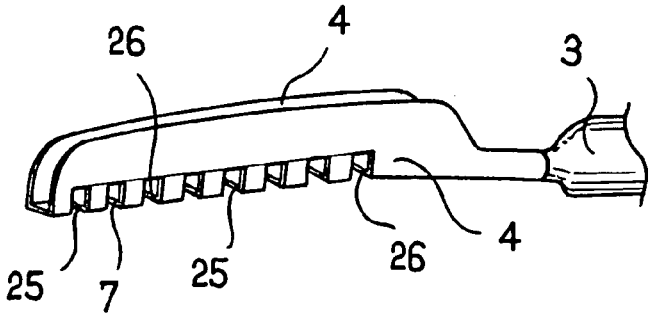
Figure 16:
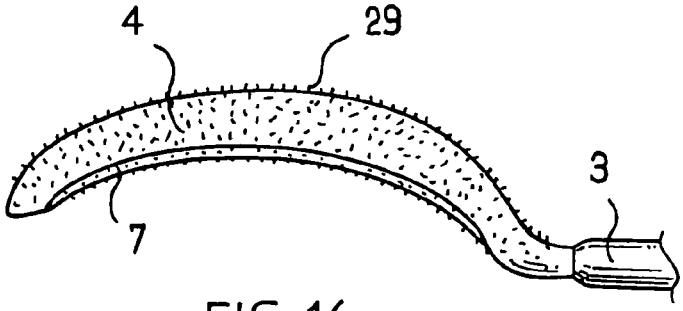

Alternatively, the slot 7 may be interrupted by at least one bridge of material 25 that connects together the two walls 4 at a point other than at the ends of the slot 7, for example, as shown in FIG. 15. The slot 21 may thus comprise a succession of orifices 26 separated by bridges of material 25.

Where appropriate, the applicator element 2 may be covered in a coating of flocking 29, for example, as shown in FIG. 16, in order to retain more substance and/or in order to enable the substance to be applied or spread using outside faces of the walls 8.

In the exemplary embodiments described above, the opening 10 formed between the walls 4 is uninterrupted between its axial ends.

Figure 17:
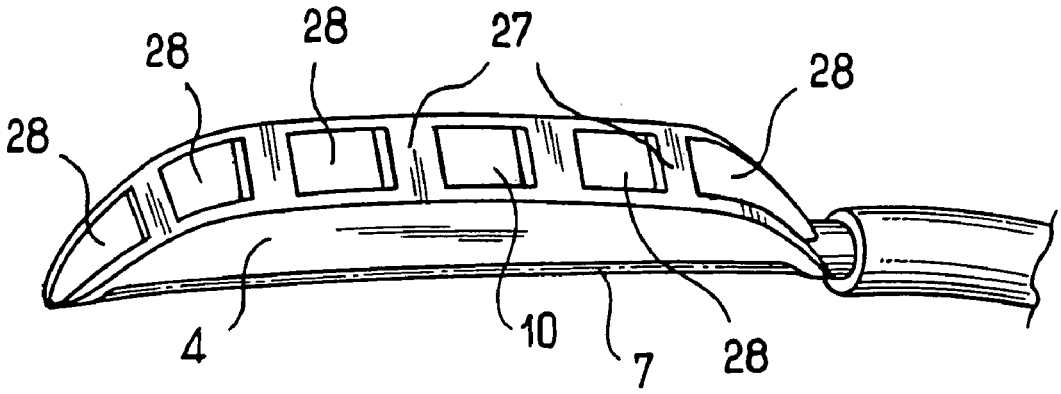

Alternatively, as shown in FIG. 17, the opening may be interrupted by one or more bridges of material 27 that interconnect the two walls 4, for example, such that the opening 10 comprises a succession of orifices 28.

Figure 20:
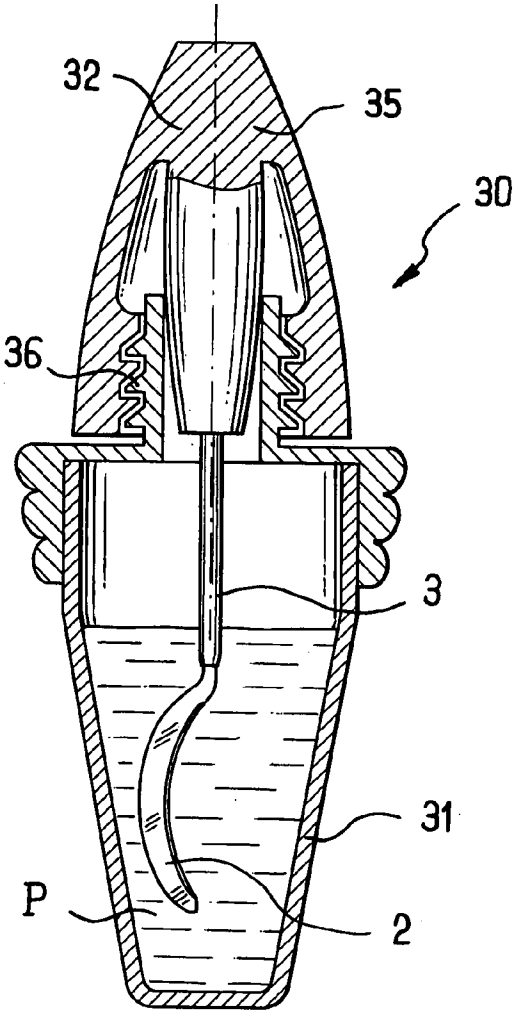

FIG. 20 shows an exemplary embodiment of a device 30 according to the invention comprising a receptacle 31 containing a substance P and an applicator 32. The applicator 32 comprises an applicator element 2, for example, as described with reference to FIG. 13, and may also comprise a handle member 35. The handle member 35 may comprise a closure cap for the receptacle 31 as well.

The applicator element 2 may be connected to the handle member/cap 35 by the stem 3.

A top portion of the receptacle 31 may have a threaded neck 36 on which the handle member/closure cap 35 can be screwed.

The applicator element 2 may be filled with substance, for example, by being inserted into the receptacle 31.

In the exemplary embodiment shown in FIG. 20, the device 30 does not have a wiper.

Figure 21:
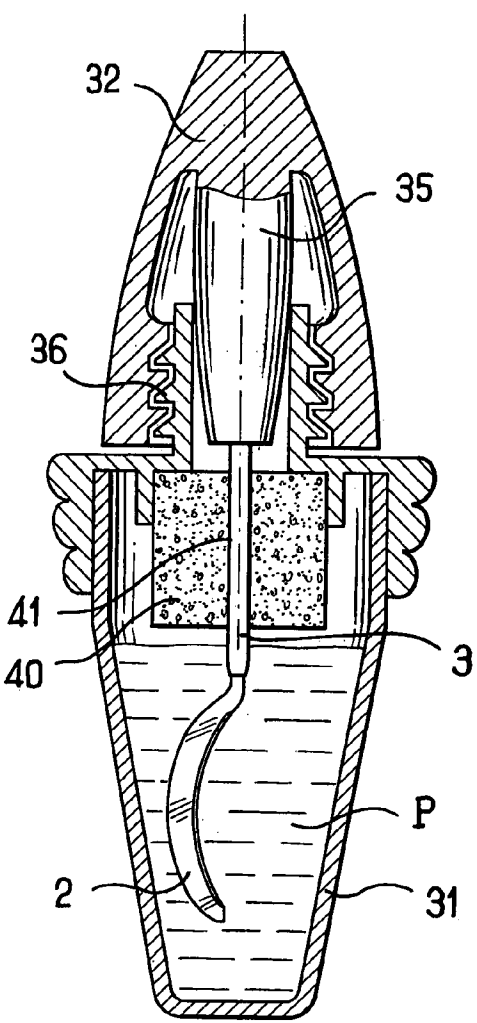
FIGS. 20 to 23 are diagrammatic axial section views of applicator devices according to various exemplary embodiments of this invention.

In the exemplary embodiment shown in FIG. 21, the receptacle 31 may house a block of foam 40, such as, for example, open-celled polyurethane, which acts as a wiper. The block of foam 40 may have at least one slot 41 that is substantially closed at rest, for example, when the applicator is absent.

The walls 4 of the applicator element 2 enable the supply of substance contained in the cavity 6 to be protected while the applicator element is passing through the wiper 40.

The receptacle may be provided with a wiper other than a block of foam.

Figure 22:
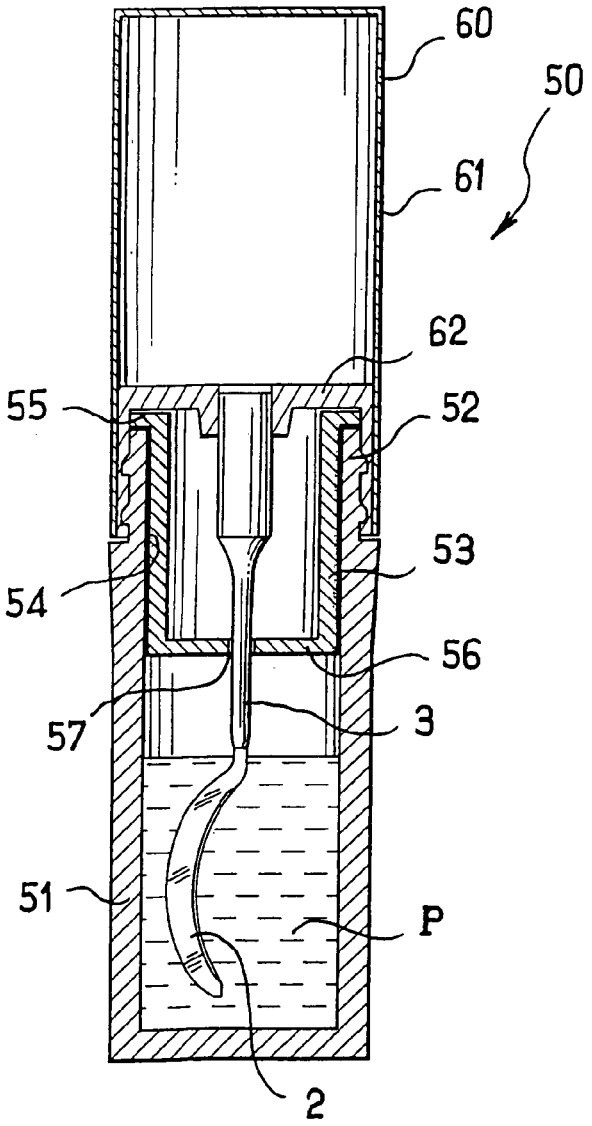

For example, FIG. 22 shows an exemplary device 50 comprising a receptacle 51 containing a substance P for application.

The receptacle 51 has a neck 52 with an outside thread and a wiper 53, for example, made of elastomer.

The wiper 53 may have a wall 54 that is substantially circularly cylindrical in shape, extending from a top end with an outwardly-directed flange 55 that rests against a top edge of the neck 52, and having a bottom end with a transverse wall 56 that is pierced by a central orifice 57 of diameter that is slightly greater than the diameter of the stem 3.

The receptacle 51 may be closed by a closure cap 60 comprising a cover 61 having fastened therein an insert 62 that receives the stem 3.

In exemplary embodiments of the present invention, the applicator element may be secured to the receptacle during application.

Figure 23:
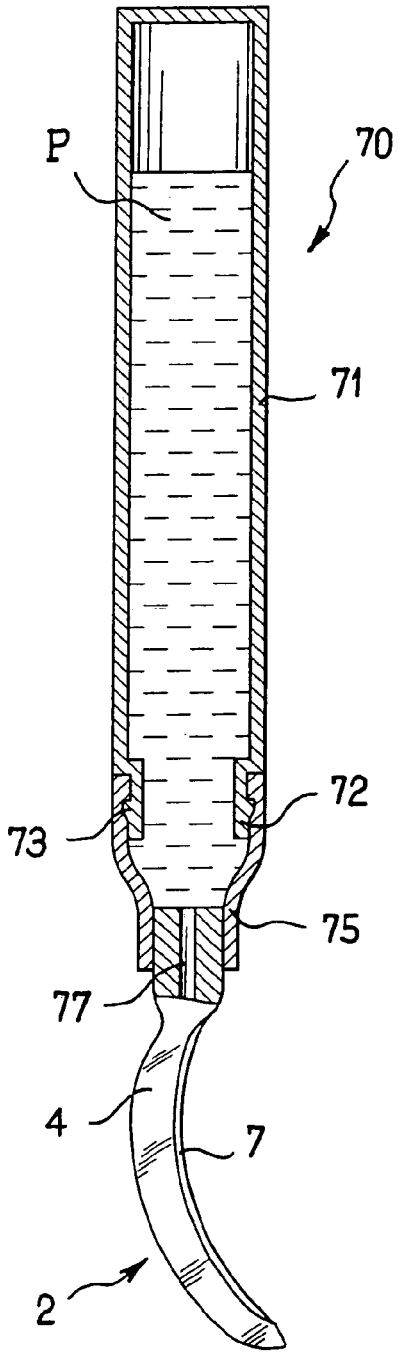

For example, FIG. 23 shows an exemplary device 70 comprising a receptacle 71 having an applicator element 2 fastened thereto.

The applicator element 2 may be fastened to the receptacle 71 in various ways. For example, the applicator element 2 may be snap-fastened to the receptacle 71. The receptacle 71 may have a neck 72 at one end. For example, the neck 72 may be provided with an annular bead 73 that enables an endpiece 75 to be fitted thereto for carrying the applicator element 2.

The applicator element 2 may include a channel 77 that opens at one end to the inside of the receptacle 71 and at the other end to the cavity 6.

In exemplary embodiments of the present invention, the slot 7 of the applicator element may extend in a direction that is not parallel to the longitudinal direction of the stem.

Figure 24:
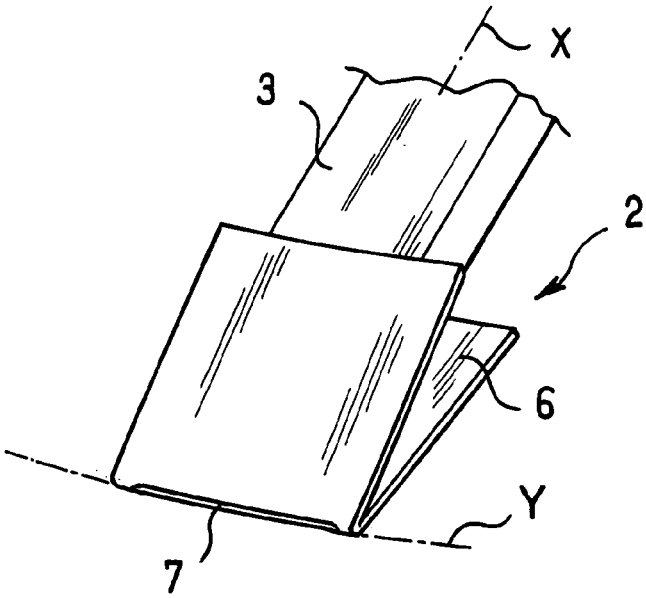
FIGS. 24 to 26 are diagrammatic and fragmentary perspective views of applicators according to various exemplary embodiments of this invention.

For example, FIG. 24 shows an applicator element 2 in which the axis Y of the slot 7 is perpendicular to the axis X of the stem 3.

In the exemplary embodiment of FIG. 24, the slot 7 is substantially rectilinear in shape.

Figure 25:
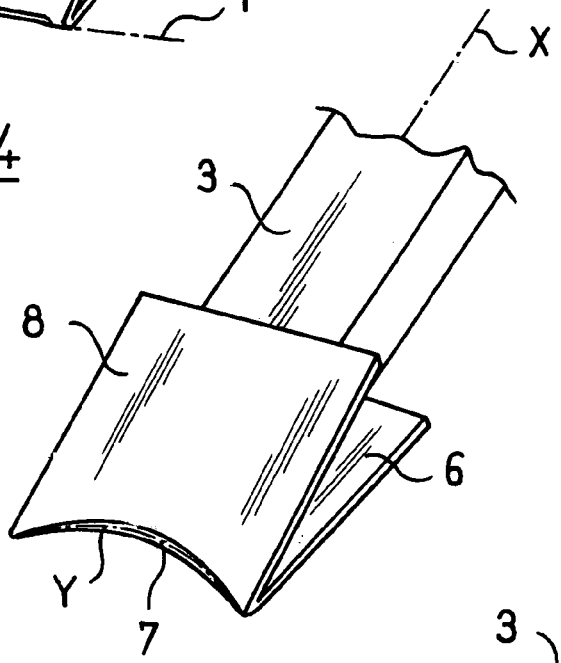

Alternatively, as shown in FIG. 25, the applicator element 2 may have a slot 7 with a shape that is outwardly concave, for example, to be capable of matching a bulging surface, such as, for example, the surface of a nail, during application.

Figure 26:
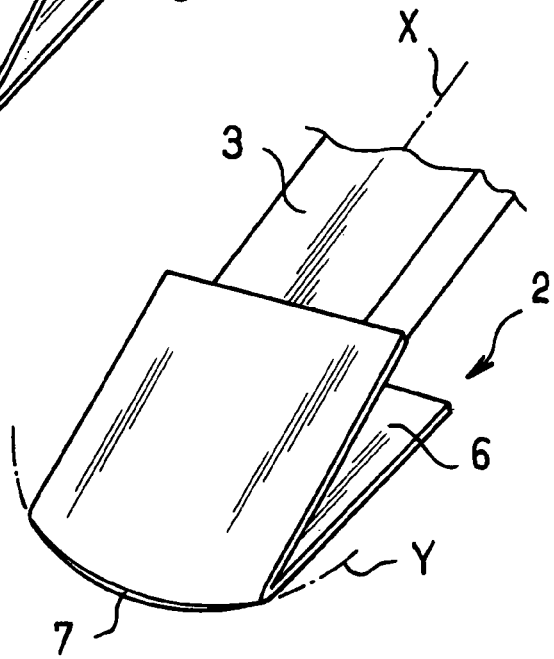

Further, as shown in FIG. 26, the slot 7 may have a shape that is outwardly convex.

Naturally, the invention is not limited to the embodiments described above, and the characteristics of the various exemplary embodiments may be combined with one another. For example, it is possible to provide the edges of the slots of the applicator elements shown in FIGS. 24 and/or 25 with teeth and/or with a coating of flocking.

Figure 27:
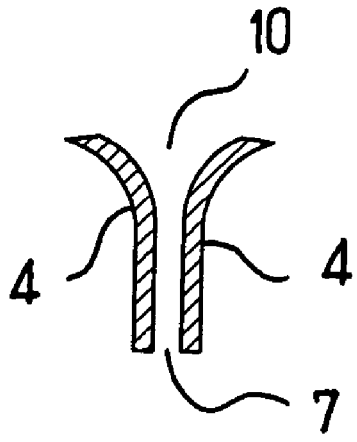
FIGS. 27 and 28 are diagrammatic and fragmentary cross-section views of applicator elements according to various exemplary embodiments of this invention.

When the applicator element has a V-shaped cross-section, the cross-section of each wall 4 may have an outwardly concave face, for example, as shown in FIG. 27. Thus, the bottom portion of one wall 4 may be substantially parallel to the bottom portion of the other wall 4, while the top portions of the walls 4 may diverge outwards.

Figure 28:
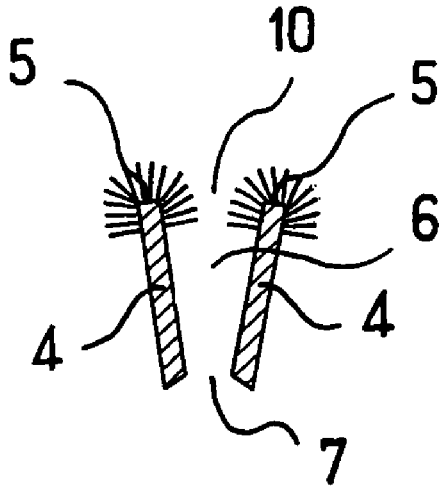

The applicator element may also be flocked in part. For example, the applicator element may be flocked only at the top edges 5, for example, as shown in FIG. 28. Thus, the substance contained in the cavity 6 can be dispensed as desired, either through the slot 7 or via the opening 10.

Throughout the foregoing description, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A packaging and applicator device for a substance, the device comprising:

a receptacle containing at least one of a cosmetic and a care substance for application to a portion of a human body; and an applicator configured to apply a substance on a portion of the human body, the applicator comprising an applicator element comprising:

at least two walls forming therebetween a cavity suitable for retaining the substance;

at least one slot that extends along a longitudinal axis and through which the substance contained in said cavity is dispensed in order to be applied; and at least one opening whereby the cavity opens to the outside, said opening comprising at least one portion with a width in a plane extending transversely to the slot that is greater than a width of the slot in the same plane.

2. A device according to claim 1, wherein the slot is situated between the two walls.

3. A device according to claim 1, wherein the walls have an elongate shape with a longitudinal axis that is substantially parallel to the axis of the slot.

4. A device according to claim 1, wherein the slot is entirely separate from the opening.

5. A device according to claim 1, wherein the slot is situated substantially opposite from the opening.

6. A device according to claim 1, wherein a cross-section of the applicator element is substantially shaped as at least one of a V-shape, a C-shape, a U-shape and a W-shape; and wherein at least one slot is formed through a bottom of a concave portion of the V-, C-, U-, or W-shape.

7. A device according to claim 6, wherein the applicator element has a V-shaped cross-section, with each limb of the V-shape having an outwardly-directed concave face.

8. A device according to claim 6, the walls defining a U-shaped cross-section, wherein the slot is formed between two substantially parallel rims connected to a bottom of the U-shape.

9. A device according to claim 1, wherein the applicator element has at least two substantially parallel slots.

10. A device according to claim 9, the two walls defining a W-shaped cross-section, wherein the two slots are formed through bottoms of two concave portions of the W-shape.

11. A device according to claim 9, the two walls defining a V-shaped cross-section, wherein the two slots are formed through either side of a bottom of a concave portion of the V-shape.

12. A device according to claim 1, wherein the slot extends in a substantially rectilinear direction.

13. A device according to claim 1, wherein the slot extends along a curve.

14. A device according to claim 13, wherein said curve is concave.

15. A device according to claim 13, wherein said curve is convex.

16. A device according to claim 13, wherein the curve is substantially a portion of one of a circle and an ellipse.

17. A device according to claim 13, wherein curve is an undulating curve.

18. A device according to claim 1, wherein the slot has edges of substantially linear shape.

19. A device according to claim 1, wherein the slot has serrated edges.

20. A device according to claim 19, wherein the edges of the slot comprise two rows of teeth.

21. A device according to claim 20, wherein the respective teeth of said rows are in registration with one another.

22. A device according to claim 20, wherein the respective teeth of said rows are disposed in a staggered configuration.

23. A device according to claim 1, wherein the slot is uninterrupted along its entire length.

24. A device according to claim 1, wherein the slot is interrupted by at least one bridge of material interconnecting the two walls.

25. A device according to claim 1, wherein the opening is uninterrupted.

26. A device according to claim 1, wherein the opening is interrupted by at least one bridge of material interconnecting the two walls.

27. A device according to claim 1 and including a stem, wherein the slot extends substantially parallel to the longitudinal direction of the stem.

28. A device according to claim 1 and further comprising a stem, the slot extending substantially perpendicularly to a longitudinal direction of the stem.

29. A device according to claim 1, wherein the applicator element is flocked, at least in part.

30. A device according to claim 29, wherein the opening has at least one edge that is flocked at least in part.

31. A device according to claim 30, wherein the opening has two substantially-parallel edges that are flocked.

32. A device according to claim 1, wherein the walls are elastically deformable.

33. A device according to claim 1, wherein the walls are made of a rigid material.

34. A device according to claim 1, wherein the applicator element comprises at least one of a thermoplastic material, a thermosetting material, an elastomer, glass, wood and metal.

35. A device according to claim 1, further comprising a handle member.

36. A device according to claim 1, wherein said substance comprises a cosmetic.

37. A device according to claim 1, wherein the applicator is releasably secured to the receptacle.

38. A device according to claim 37, wherein the applicator is arranged to be capable of closing the receptacle in a leaktight manner.

39. A device according to claim 37, further comprising a wiper.

40. A device according to claim 39, wherein the wiper comprises a block of foam.

41. A device according to claim 1, wherein the applicator is permanently fixed to the receptacle and includes an internal channel that enables the substance contained in the receptacle to flow into the cavity of the applicator element.

42. A method for applying a substance to at least one of the body and the face comprising:

dispensing the substance to at least one of the body and the face with an applicator configured to apply said substance on a portion of the human body, the applicator comprising an applicator element comprising:

at least two walls forming therebetween a cavity suitable for retaining the substance;

at least one slot that extends along a longitudinal axis and through which the substance contained in said cavity is dispensed in order to be applied; and at least one opening whereby the cavity opens to the outside, said opening comprising at least one portion with a width in a plane extending transversely to the slot that is greater than a width of the slot in the same plane.

43. The method according to claim 42, wherein the substance is applied to at least one of nails, eyelashes, eyebrows, skin and lips.

44. A method of applying a substance to a portion of the human body, the method comprising:

providing an applicator comprising:

at least two walls forming therebetween a cavity suitable for retaining the substance;

at least one slot that extends along a longitudinal axis and through which the substance contained in said cavity is dispensed in order to be applied; and at least one opening whereby the cavity opens to the outside, said opening comprising at least one portion with a width in a plane extending transversely to the slot that is greater than a width of the slot in the same plane;

loading the cavity with substance; and applying the substance to the portion of the human body via at least one of the slot and the opening.

45. A method according to claim 44, wherein the opening comprises at least one edge that is flocked at least in part.

46. A method according to claim 45, wherein the opening comprises two opposite edges that are flocked.

47. A device according to claim 1, wherein said substance comprises a care product.

* * * * *